US005346064A

United States Patent [19]

Rizzuto

[11] Patent Number: 5,346,064

[45] Date of Patent: Sep. 13, 1994

[54] CENTER-PULL ROLL PRODUCT DISPENSER PACKAGE

[75] Inventor: Jack A. Rizzuto, Antioch, Calif.

[73] Assignee: James River Paper Company, Inc., Richmond, Va.

[21] Appl. No.: 22,301

[22] Filed: Feb. 25, 1993

[51] Int. Cl.[5] ..... B65H 16/00

[52] U.S. Cl. ..... 206/409; 221/302; 221/63; 225/106; 206/390; 206/812; 312/34.8

[58] Field of Search ..... 312/34.8, 34.1; 221/63, 221/302; 225/106; 206/409, 812

[56] References Cited

U.S. PATENT DOCUMENTS

| | | | |
|---|---|---|---|
| 2,864,495 | 12/1958 | Ritchie . | |
| 3,608,710 | 9/1971 | Pugh | 206/409 |
| 3,986,479 | 10/1976 | Bonk . | |
| 4,159,795 | 7/1979 | Friedman | 206/409 |
| 4,171,047 | 10/1979 | Doyle et al. . | |
| 4,219,129 | 8/1980 | Sedwick . | |
| 4,262,816 | 4/1981 | Margulies . | |
| 4,373,687 | 2/1983 | Zicko | 206/409 |
| 4,426,221 | 3/1984 | Margulies . | |
| 4,583,642 | 4/1986 | Blythe et al. . | |
| 4,905,868 | 3/1990 | Beane | 221/63 |
| 5,141,171 | 8/1992 | Yang . | |
| 5,219,126 | 1/1993 | Schutz | 206/409 |
| 5,246,137 | 9/1993 | Schutz | 206/409 |

FOREIGN PATENT DOCUMENTS

| | | | |
|---|---|---|---|
| 485534 | 8/1952 | Canada | 206/409 |
| 7900371 | 7/1980 | Netherlands | 221/63 |

*Primary Examiner*—Brian K. Green
*Assistant Examiner*—David E. Allred
*Attorney, Agent, or Firm*—Thomas R. Lampe

[57] ABSTRACT

A dispenser package includes a container having an interior and a dispensing aperture communicating with the interior. A coreless, center-pull roll product is positioned in the interior, the roll product having a central opening and a lead end connected to the innermost convolution. The dispenser package also includes a dispenser nozzle which is maintained in the roll product central opening until dispensing is desired.

8 Claims, 2 Drawing Sheets

CENTER-PULL ROLL PRODUCT DISPENSER PACKAGE

TECHNICAL FIELD

This invention relates to the dispensing of sheet material from a roll product such as a roll of paper toweling. More particularly, the apparatus of the present invention is a dispenser package of inexpensive construction which has one configuration when shipped and stored and another when the roll product of the package is being dispensed.

BACKGROUND ART

A number of dispensers exist in the prior art for dispensing paper toweling, paper tissue, non-woven sheets and like. Some of these dispensers are of the "center-pull" type wherein a web of paper toweling or other sheet material is pulled from the center of a coreless roll through a nozzle or other restrictor element forming a restricted passageway. Assuming that the individual sheets of toweling or the like are connected by perforation lines, as is common, the nozzle or other restrictor element will resist pulling of the sheet material by the user and cause an individual sheet to break from the remaining web along the perforation line interconnecting same. Similar arrangements exist wherein sheets are torn from a non-perforated web, often incorporating cutter teeth or blades to sever a manually manipulated sheet from the web.

While most center-pull dispensers are in the form of hardware permanently attached at their location of use, it is also known to provide what are, in effect, disposable packages which hold and protect the coreless roll product during shipment and storage and also provide a means whereby the coreless roll product is manually dispensed. Upon depletion of the roll product the remaining package may be disposed of or recycled.

The following United States patents are believed to be exemplary of the prior art: U.S. Pat. No. 2,864,495, issued Dec. 16, 1958, U.S. Pat. No. 4,262,816, issued Apr. 21, 1981, U.S. Pat. No. 4,583,642, issued Apr. 22, 1986, U.S. Pat. No. 3,986,479, issued Oct. 19, 1976, U.S. Pat. No. 4,171,047, issued Oct. 16, 1979, U.S. Pat. No. 4,219,129, issued Aug. 26, 1980, U.S. Pat. No. 4,436,221, issued Mar. 13, 1984, and U.S. Pat. No. 5,141,171, issued Aug. 25, 1992.

U.S. Pat. No. 2,864,495 is believed worthy of special comment. The patent discloses a dispenser for paper product rolls such as rolls of facial tissue. The dispenser includes a container member having an end wall with a removable portion defined by a scored or perforated section defining an access or central aperture portion in the end wall. An innermost sheet of the coreless roll of paper material has a corner secured to the undersurface of the removable portion to draw the paper material out of the central aperture of the container. In use, the desired quantities of tissue are manually pulled directly through the hole or aperture formed in the container end wall.

The arrangement of U.S. Pat. No. 2,864,495, while simple and inexpensive, would appear to lack reliability and not function properly due to the fact that the tissue is drawn through an opening defined by the container wall itself. That is, the length of the passageway defined by the opening does not exceed the thickness of the relatively thin paperboard utilized to form the container. Furthermore, the hole itself has a relatively large diameter and does not provide the restriction necessary to ensure proper separation of individual sheets from the tissue web.

U.S. Pat. No. 4,262,816 discloses a package and dispensing device for a contiguous roll of premoistened toilet towelettes which includes an outer container holding a roll of premoistened towelettes surrounded by a bag. The towelettes are pulled away from the roll through a hole in a sealing and dispensing plate located within the container interior and pulled out of the top of the container. It is suggested that the plate may be either planar or conical. In any event, the plate is thin and movably mounted within the container. The plate only engages the top of the container temporarily when the product is being pulled and removed. Such an arrangement will not have the degree of reliability found in an arrangement wherein a dispenser nozzle is affixed in place relative to the container and defines a relatively elongated passageway for the dispensed product.

DISCLOSURE OF INVENTION

The present invention relates to a dispenser package which readily lends itself to storage and shipment and maintains the roll product incorporated in the package in a safe, clean condition due to the fact that the package container is substantially closed. When dispensing is desired, however, the dispensing package may readily be reconfigured to allow dispensing of the roll product in a reliable manner through a dispenser nozzle fixed to the package container at the time of use. The dispenser nozzle during storage and shipment is maintained in a safe, clean environment within the central opening of the coreless, center-pull roll product within the container.

More specifically, the dispenser package of the present invention includes a container having a plurality of interconnected walls defining an interior, at least one of the walls defining a dispensing aperture communicating with the interior.

A coreless, center-pull roll product formed by overlapping convolutions of web material is positioned within the interior. The coreless, center-pull roll product has a central opening extending therethrough defined by an innermost convolution of the web material and a lead end connected to the innermost convolution.

A dispenser nozzle is provided which defines a passageway for the lead end. The dispenser nozzle is located within the coreless, center-pull roll product central opening and is surrounded by the innermost convolution of the web material prior to dispensing of the coreless, center-pull roll product. The dispenser nozzle is located externally of the central opening and connected to the container at the dispenser aperture during dispensing of the coreless, center-pull roll product.

The dispenser package additionally comprises a removable closure element closing the dispensing aperture prior to dispensing of the coreless, center-pull roll product.

The coreless, center-pull roll product lead end extends through the dispenser nozzle passageway when the dispenser nozzle is located within the coreless, center-pull roll product central opening and also when the dispenser nozzle is connected to the container at the dispensing aperture.

Connector means is provided for connecting the dispenser nozzle to the container during dispensing of the coreless, center-pull roll product with the dispenser nozzle projecting outwardly through the dispensing aperture.

Other features, advantages, and objects of the present invention will become apparent with reference to the following description and accompanying drawings.

BEST MODE FOR CARRYING OUT THE INVENTION

Figure 1:
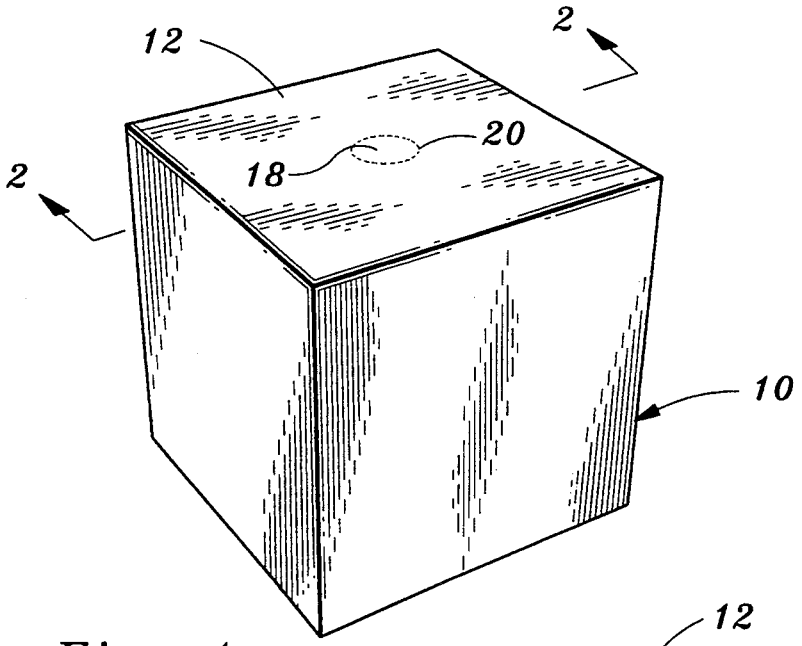
FIG. 1 is a perspective view of the closed container of a package constructed in accordance with the teachings of the present invention.

Referring now to the drawings, a dispenser package constructed in accordance with the teachings of the present invention includes a container 10 in the form of a box having a plurality of interconnecting walls including wall 12. The interconnected walls define an interior 14.

Figure 2:
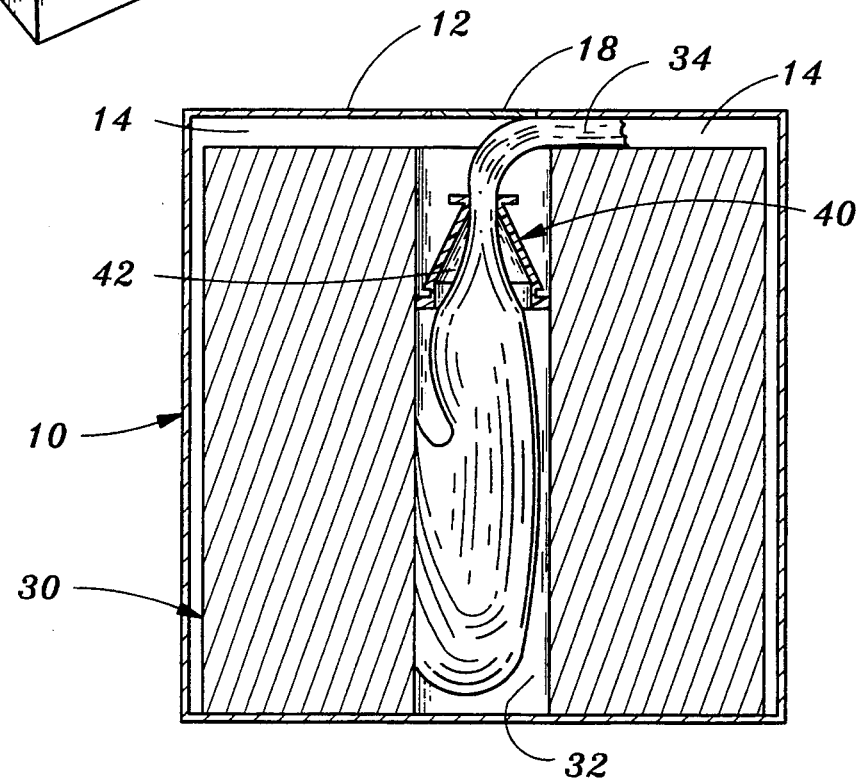
FIG. 2 is an enlarged, cross-sectional view taken along the line 2—2 of FIG. 1.
Figure 4:
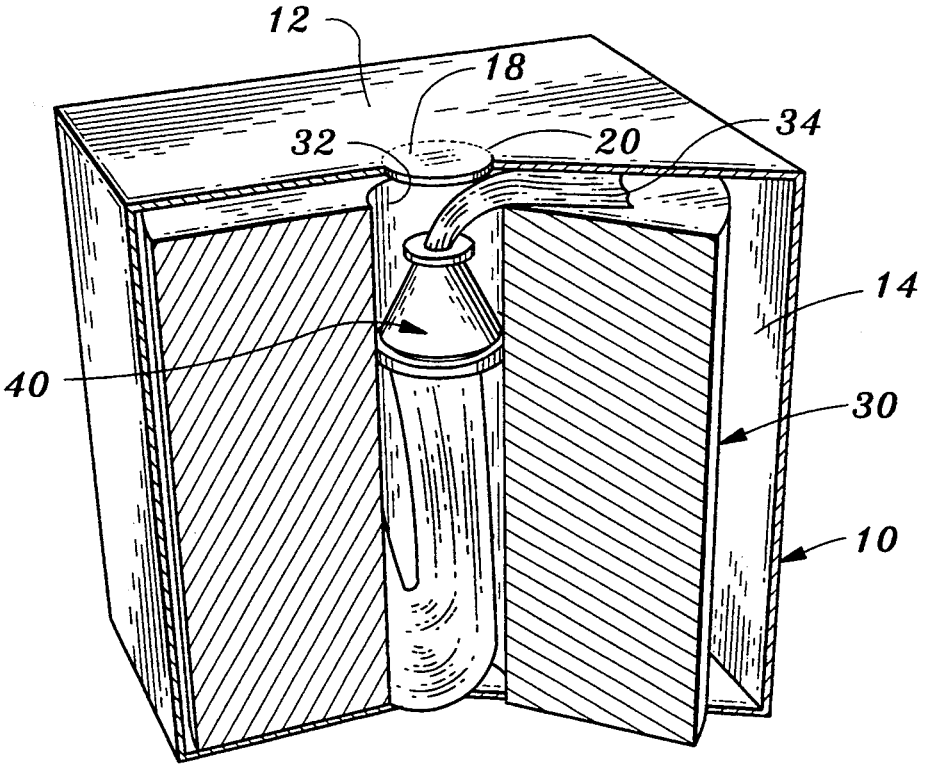
FIG. 4 is a perspective, sectional view illustrating the components of the dispenser package and the relative positions assumed thereby during shipment and storage of the dispenser package, i.e. prior to dispensing.

Wall 12 defines a dispensing aperture 16 communicating with interior 14. As shown in FIGS. 1, 2 and 4, dispensing aperture 16 is normally covered by a closure element 18 in the form of a disc which is connected to wall 12 along a tear line 20 defined by spaced perforations cut into wall 12. Alternatively, a score line or other suitable means of securement could be used for such purpose. The closure element 18 remains in place until a consumer wishes to dispense the contents of the container. The closure element is readily removed manually by application of sufficient force thereto to break the interconnection between the closure element and the surrounding wall 12.

A coreless, center-pull roll product formed by overlapping convolutions of web material is positioned in the container interior. In the disclosed embodiment, the roll product is a coreless paper towel roll 30. Roll 30 has a central opening 32 extending therethrough which is defined by an innermost convolution of the paper toweling. The paper towel roll also has a lead end 34 connected to the innermost convolution. Although not shown, it is to be understood that the paper toweling incorporates spaced perforation lines which divide the toweling web into separate towels. The central opening 32 has an inner peripheral cross-section of substantially uniform predetermined magnitude along the length thereof.

Disposed within the central opening 32 and surrounded by the innermost convolution of the paper toweling is a dispenser nozzle 40. As will be discussed in greater detail below, the dispenser nozzle 40 is to be manually retrieved from such location when actual dispensing of the paper toweling is to take place.

Dispenser nozzle 40 defines a passageway 42 through which extends the lead end 34 of the towel roll. The distal end of the lead end is located on top of the roll and under wall 12, as shown in FIG. 2, for example.

Dispenser nozzle 40 includes a nozzle body 44 and a flange 46 radiating outwardly from the nozzle body. The nozzle body and the flange define a peripherally extending recess 48.

Figure 3:
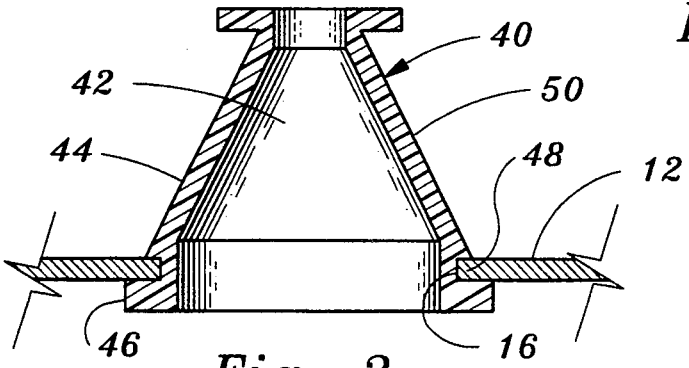
FIG. 3 is a greatly enlarged, cross-sectional, side view of the dispenser nozzle of the present invention in dispensing position on a wall of the container and projecting through a dispensing aperture in the wall.

The nozzle body 44 has a generally cone-like configuration, with an outer peripheral wall 50 converging as the outer wall extends away from the flange 46. The outer peripheral wall 50 has a maximum circumference where the outer peripheral wall meets to the peripherally extending recess 48. This perhaps is best shown in FIG. 3. The dispensing aperture 16 in wall 12 has a circumference of lesser magnitude than the outer peripheral wall maximum circumference. The dispenser nozzle may be formed of any suitable material, such as plastic. The container itself may also be formed of any suitable material, such as paperboard.

The container 10 with closure element 18 protects the roll product and the nozzle and maintains their cleanliness and prevents damage thereof during shipment and storage of the complete dispenser package. Also, since the nozzle 40 is maintained entirely within the container, it will not interfere with stacking or other material handling tasks.

Figure 5:
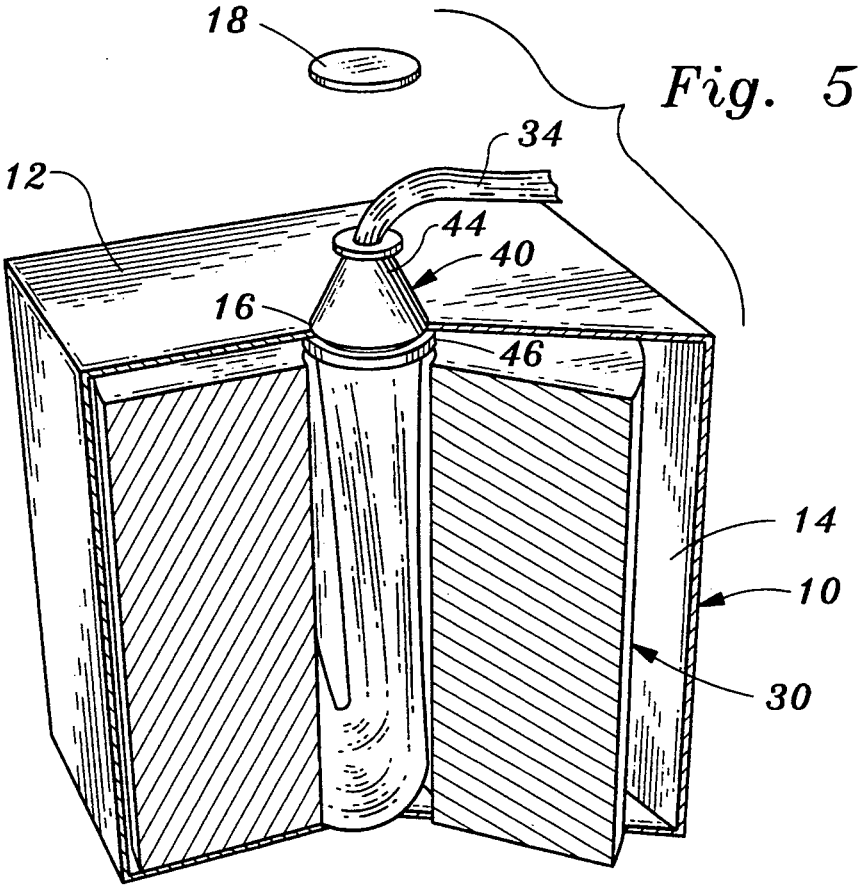
FIG. 5 is a perspective, sectional, exploded view showing the closure element of the dispenser package removed from the container and the dispenser nozzle in dispensing position on the container with a lead end of the roll product located exteriorly of the container interior.

When dispensing is desired, the closure element 18 is removed and the roll product lead end 34 and dispenser nozzle 40 are manually retrieved from the container interior and pulled upwardly to the position shown in FIG. 5. The wall 12 is somewhat flexible and deforms to allow passage of the nozzle body 44 therethrough, after which the wall will snap into recess 48 to maintain the dispenser nozzle 40 in a position shown in FIGS. 3 and 5 where only the flange 46 is located within the container interior. The consumer is now free to dispense the paper toweling or other sheet material through the dispenser nozzle in a conventional manner.

By sizing the flange 46 so that it frictionally engages the innermost convolution of the roll when the dispenser nozzle is in its stored position in central opening 32, such frictional engagement can be utilized to maintain the nozzle at the end of the roll product adjacent to dispensing aperture 16 so that ready manual access to the nozzle may be had to pull it to dispensing position. Likewise, by maintaining the lead end of the roll product pinched between wall 12 an end of the roll product, the lead end will be maintained in readily accessible position through the dispensing aperture prior to dispensing.

I claim:

1. A dispenser package comprising, in combination:

a container including a plurality of interconnected walls defining an interior, at least one of said walls defining a dispensing aperture communicating with said interior;

a coreless, center-pull roll product formed by overlapping convolutions of web material positioned in said interior, said coreless, center-pull roll product having a central opening extending therethrough in at least partial registry with said dispensing aperture defined by an innermost convolution of said web material and a lead end connected to said innermost convolution;

a dispenser nozzle defining a passageway for said lead end, said dispenser nozzle positionable substantially wholly located within the confines of the coreless, center-pull roll product central opening, completely surrounded by said innermost convolution of said web material and completely within said interior which defines a first position, said nozzle being moveable to a second position spaced from said first position wherein said dispenser nozzle has at least a portion thereof located externally of said central opening, projects through said dispensing aperture and is connected to said container at said dispensing aperture during dispensing of said coreless, center-pull roll product; and a removable closure element for closing said dispensing aperture prior to dispensing of said coreless, center-pull roll product when said dispenser nozzle is located in said first position, said coreless, center-pull roll product lead end extending through said dispenser nozzle passageway both when said dispenser nozzle is located at said first position within said coreless, center-pull roll product central opening and also when said dispenser nozzle is located at said second position and is connected to said container at said dispensing aperture.

2. The dispenser package according to claim 1 wherein said web material is paper.

3. The dispenser package according to claim 1 wherein said removable closure element is releasably connected to a container wall along a tear line.

4. The dispenser package according to claim 1 wherein said dispenser nozzle includes connector means for connecting said dispenser nozzle to said container during dispensing of said coreless, center-pull roll product with said dispenser nozzle at said second position projecting outwardly through said dispensing aperture.

5. The dispenser package according to claim 1 wherein said dispenser nozzle includes a nozzle body and a flange radiating outwardly from said nozzle body, said nozzle body and said flange defining a peripherally extending recess which accommodates a container wall to connect said dispenser nozzle to said container at said second position during dispensing of said coreless, center-pull roll product.

6. The dispenser package according to claim 5 wherein said nozzle body has a generally cone-like configuration, with an outer peripheral wall converging as said outer peripheral wall extends away from said flange, said outer peripheral wall having a maximum circumference where the outer peripheral wall meets said peripherally extending recess, said dispensing aperture having a circumference of lesser magnitude than the said outer peripheral wall maximum circumference, the container wall defining said dispensing aperture being flexibly deformable to allow passage of said nozzle body therethrough.

7. The dispenser package according to claim 1 wherein the dispenser nozzle frictionally engages said innermost convolution to resist movement of said dispenser nozzle relative to said coreless, center-pull roll product when said dispenser nozzle is located at said first position in said central opening.

8. The dispenser package according to claim 1 wherein said lead end frictionally engages a wall of said container when said dispenser nozzle is located at said first position in said central opening.

* * * * *